US006561362B1

(12) United States Patent
Cummins

(10) Patent No.: US 6,561,362 B1
(45) Date of Patent: May 13, 2003

(54) DEVICE FOR SUPPORTING AND DISPLAYING FUNNELS

(75) Inventor: Jim Cummins, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 10/128,740

(22) Filed: Apr. 24, 2002

(51) Int. Cl.[7] ..... A47F 7/00

(52) U.S. Cl. ..... 211/49.1; 211/59.1; 211/106; 248/220.41

(58) Field of Search ..... 211/59.1, 49.1, 211/106, 87.01, 54.1; 248/220.41, 220.42, 220.43; 312/42, 43

(56) References Cited

U.S. PATENT DOCUMENTS

D123,126 S * 10/1940 Howell et al.
3,481,481 A * 12/1969 Witek et al. ..... 211/49.1
3,524,616 A * 8/1970 Marschak
3,774,320 A * 11/1973 Folberth
4,343,405 A * 8/1982 Virte et al. ..... 211/106 X
5,425,461 A * 6/1995 Larson ..... 211/59.1 X
6,141,894 A * 11/2000 Thalenfeld et al. .... 211/59.1 X
6,334,540 B1 * 1/2002 Plutsky ..... 211/59.1 X

* cited by examiner

*Primary Examiner*—Robert W. Gibson, Jr.
(74) *Attorney, Agent, or Firm*—Hovey Williams LLP

(57) ABSTRACT

A wire rack device (10) for supporting and displaying a plurality of stacked funnels (12) in a manner and an orientation which facilitates easier and more convenient consideration, removal, and replacement of one or more of the funnels (12) by customers while shopping and by employees while stocking. The device (10) broadly comprises two sidepieces (16,17); a forward crosspiece (18); a faceplate (20); two legs (22,23); and a centerpiece (24). In a preferred embodiment, the sidepieces (16,17), the crosspiece (18), and the legs (22,23) are constructed of a single length of wire appropriately bent. Similarly, the centerpiece (24) is also be constructed of a single length of wire appropriately bent and welded to the legs (22,23).

17 Claims, 3 Drawing Sheets

DEVICE FOR SUPPORTING AND DISPLAYING FUNNELS

BACKGROUND OF THE INVENTION

1. Field of the Invention

The present invention relates broadly to devices for supporting and displaying funnels. More particularly, the present invention concerns a wire rack device for supporting and displaying a plurality of stacked funnels in a manner and an orientation which facilitates easier and more convenient consideration, removal, and replacement of one or more of the funnels by customers while shopping and by employees while stocking.

2. Description of the Prior Art

It is often desirable to display or otherwise provide a plurality of stacked funnels for easy and convenient consideration, removal, and replacement of one or more of the funnels while maintaining a professional, clean, and otherwise properly appearing display. This is particularly true in retail store settings, for example, where the displayed funnels may be repeatedly handled by customers who remove and replace the funnels and by employees who stock and restock more funnels.

It is well-known in the prior art to display funnels in their original packaging, typically a paperboard box, by simply opening and placing the packaging on a shelf or designated floor space. Unfortunately, the original packaging seldom presents a professional or otherwise desirable appearance or an appearance conducive to generating customers' interest or allowing them to easily view the funnels, thereby substantially decreasing the funnels' "shop-ability". Furthermore, while the funnels may be initially provided in the packaging in a neat, stacked manner, the packaging includes no features for maintaining the funnels in this manner, such that repeated removal and replacement of the funnels will likely result in an unsightly jumble which requires tedious straightening and restacking. Additionally, the original packaging typically does not allow for maximizing or otherwise optimizing use of shelf space, thereby wasting display space which could otherwise hold more funnels or other goods.

It is similarly well-known to remove the funnels from their original packaging and simply stack them freely on a shelf for display. This display method, however, suffers from many of the aforementioned disadvantages and further fails to provide any substantial containment of improperly replaced funnels, such that they may eventually become strewn about and possibly even fall off the shelf.

A variety of other methods and mechanisms for displaying and supporting funnels exist in the prior art, but all typically suffer from these other disadvantages which result eventually in an unkempt and unprofessional-appearing display or which require substantial effort or labor to maintain.

Due to these and other problems and disadvantages in the prior art, a need exists for an improved device for supporting and displaying funnels.

SUMMARY OF THE INVENTION

The present invention overcomes the above-identified and other disadvantages in the prior to provide a distinct advance in the art of devices for supporting and displaying funnels. More particularly, the present invention provides a wire rack device for supporting and displaying a plurality of stacked funnels in a manner and an orientation which facilitates easier and more convenient consideration, removal, and replacement of one or more of the funnels by customers while shopping and by employees while stocking. Furthermore, the device is operable to facilitate maintaining a professional and clean display without requiring additional undue labor.

In a preferred embodiment, the device broadly comprises two sidepieces; a forward crosspiece; a faceplate; two legs; and a centerpiece. The two sidepieces provide horizontal support for displaying and maintaining the funnels in the aforementioned proper display orientation. The sidepieces are oriented parallel to and spaced apart from one another. The crosspiece extends between and couples the two sidepieces, thereby enhancing the stability of the device and ensuring proper spacing between the sidepieces. The faceplate is secured to the crosspiece and provides a surface onto which a price or other label may be affixed for communicating a unit price, bar code, or other information related to the funnels.

The two legs provide a mechanism by which the device may be secured to a pegboard or similar material presenting at least two spaced-apart holes through which the legs may be inserted. The legs are oriented parallel to and spaced apart from one another, and each presents a lower end and an upper end. At its lower end, each leg is coupled with a different one of the sidepieces at an angle of approximately 85° or, as desired, at any other suitable angle between approximately 45° and 120°. At its upper end, each leg is adapted for engaging one of the holes of the pegboard. As illustrated, each upper end presents a substantially S-shaped jog or offset portion allowing it to be inserted into one of the holes in the pegboard and to rest against a rear surface of the pegboard. The remainder of each leg, particularly each lower end, then rests against a front surface of the pegboard. In this manner, the legs both support the device from and couple it with the pegboard, thereby preventing the device from falling or being inadvertently pulled therefrom.

The centerpiece provides a mechanism for engaging the stacked funnels so as to maintain them in the proper orientation relative to the remainder of the device. The centerpiece is substantially T-shaped, having a rear bar and a center projection. The rear bar extends between and couples the two legs. The center projection is coupled with an approximate center of the rear bar to project forwardly therefrom substantially parallel to and spaced apart from each of the sidepieces. The center projection is sized and positioned to pass through at least one or more of the funnels. Thus, the centerpiece and sidepieces cooperate to support the stacked funnels in the proper display orientation.

As desired, the sidepieces, crosspiece, and legs may be constructed of a single length of steel wire appropriately bent. Similarly, the centerpiece may also be constructed of a single length of steel wire appropriately bent to form the rear bar and center projection.

Thus, it will be appreciated that the device provides a number of significant advantages over the prior art, including, for example, supporting and displaying the funnels in a manner and an orientation which enhances shop-ability by facilitating easier and more convenient consideration, removal, and replacement of one or more of the funnels. Furthermore, a funnel, once removed, can be easily returned to the stack without disturbing other funnels, thereby facilitating maintaining a professional-appearing, properly stacked, and otherwise clean display. Additionally, the device substantially increases optimization of retail shelf space by allowing for the display of a maximum number of funnels in the smallest space possible.

These and other important aspects of the present invention are more fully described in the section entitled DETAILED DESCRIPTION, below.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

Figure 1:
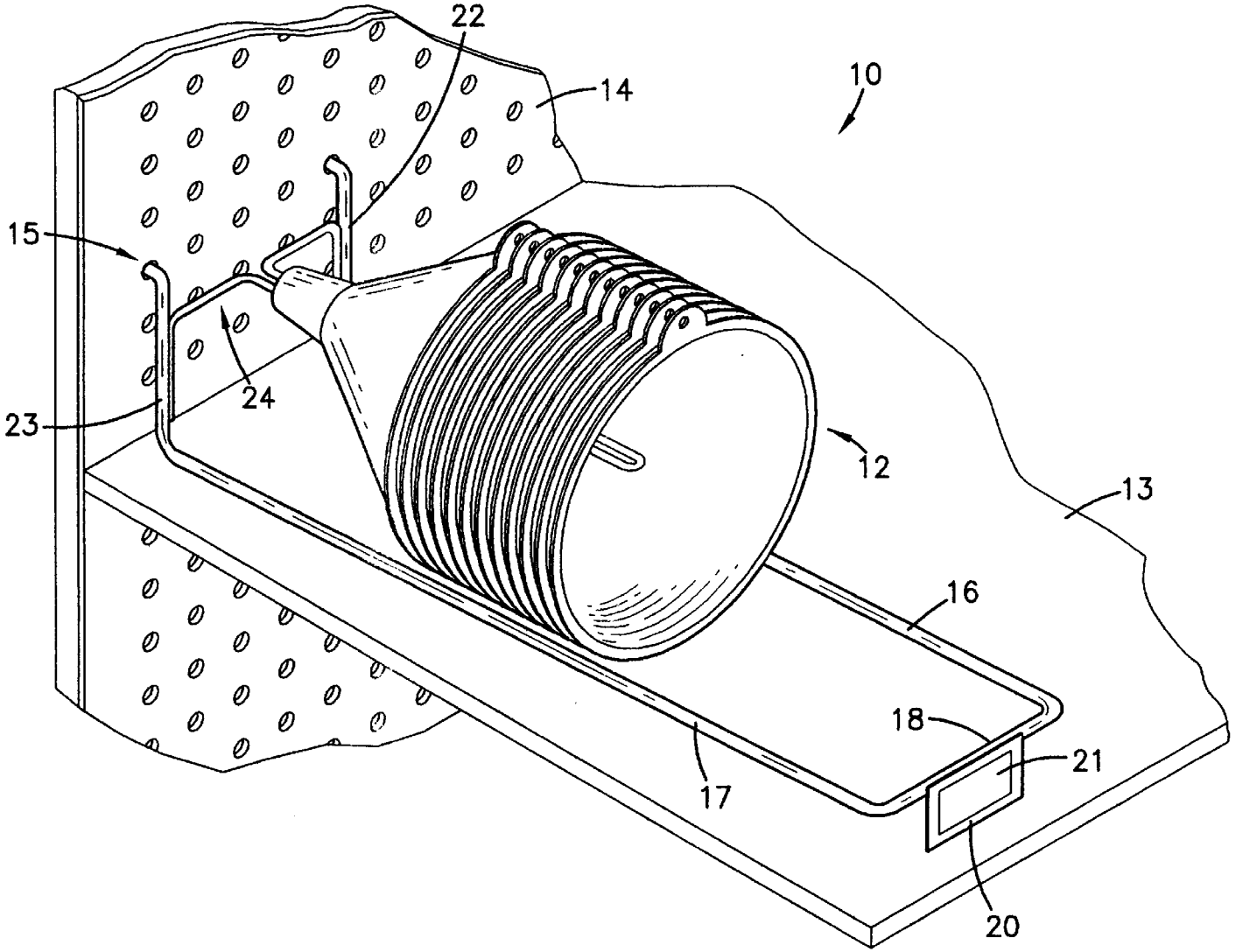
FIG. 1 is an isometric view of a preferred embodiment of the device of the present invention, wherein a plurality of stacked funnels are shown supported by and displayed on the device.

Referring to the figures, a wire rack device 10 is shown constructed in accordance with a preferred first embodiment of the present invention. The device 10 is operable to support and display a plurality of stacked funnels 12 in a manner and an orientation which facilitates easier and more convenient consideration, removal, and replacement of one or more of the funnels 12 by customers while shopping and by employees while stocking. Referring particularly to FIG. 1, the device 10 is meant to be associated with a common horizontally-oriented merchandise display shelf 13 and to engage a common vertically-oriented pegboard surface 14 or other material presenting at least two spaced-apart holes 15 and located at or near a back of the shelf 13.

Figure 2:
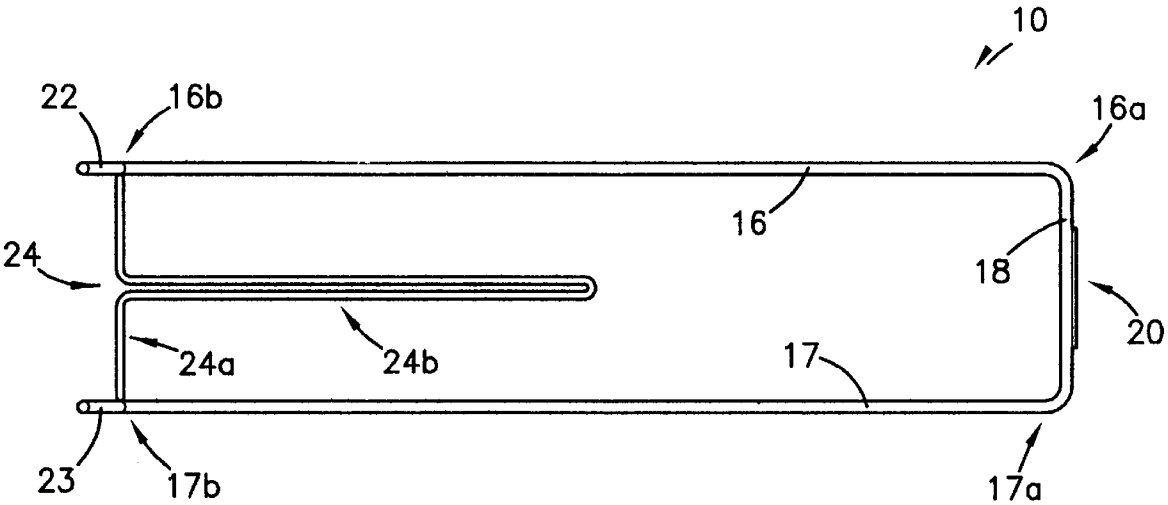
FIG. 2 is a top plan view of a preferred embodiment of the device of FIG. 1.
Figure 3:
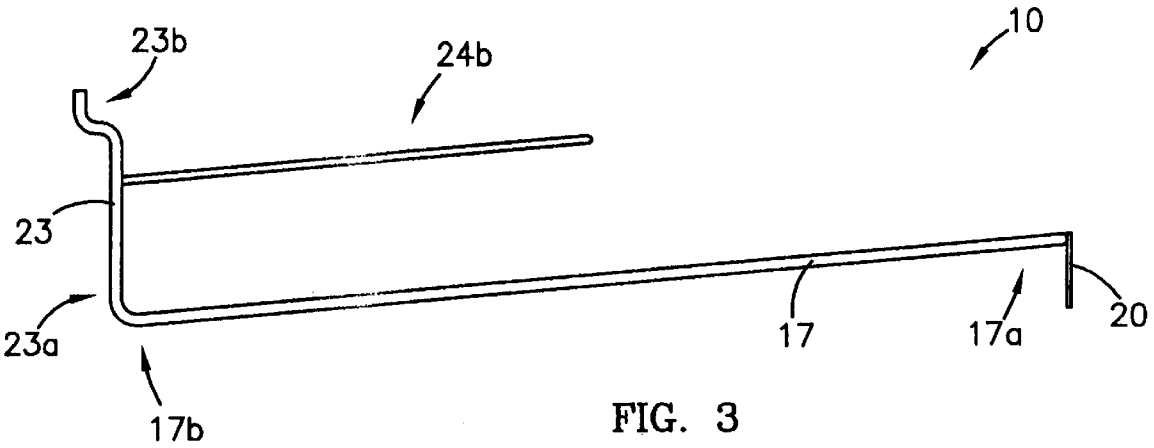
FIG. 3 is a left side elevation view of the device of FIG. 1.
Figure 4:
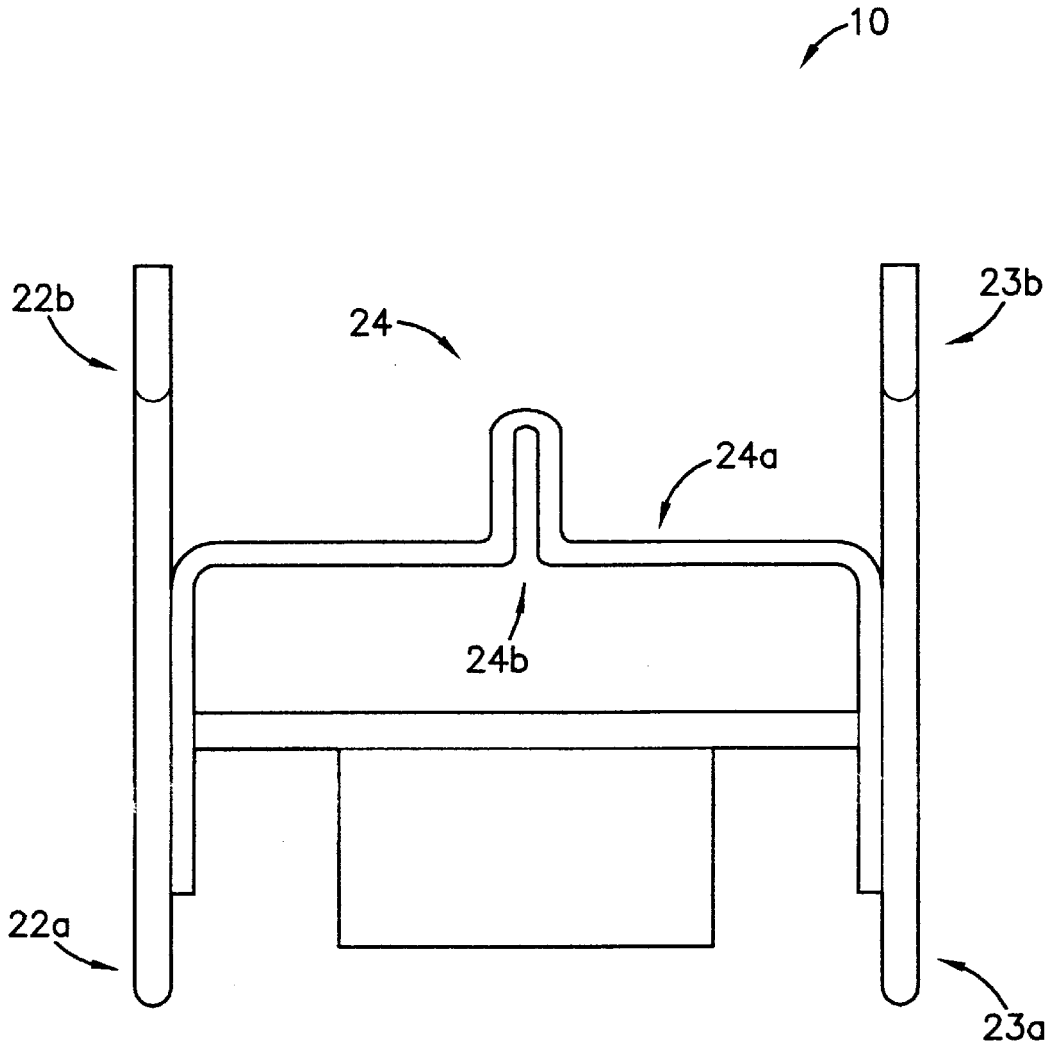
FIG. 4 is a rear elevation view of the device of FIG. 1.

Referring also to FIGS. 2–4, in a preferred embodiment the device 10 broadly comprises two sidepieces 16,17; a forward crosspiece 18; a faceplate 20; two legs 22,23; and a centerpiece 24. These component parts of the device 10 may be constructed of any suitable material, including, for example, steel, aluminum, or plastic. For purposes; of illustration, however, the device 10 is described herein as being constructed primarily of welded steel wire and dimensioned to support and display approximately twenty of the six-inch diameter funnels 12. It will be appreciated, however, that the device 10 is generally independent of any particular type or brand of funnel, and so may be adapted and configured for use with any substantially. conventional and commonly available funnels such as, for example, circular or rectangular plastic or metal funnels having four, six, or eight-inch diameters.

The two sidepieces 16,17 provide horizontal support for maintaining and displaying the funnels 12 in the aforementioned proper orientation. The sidepieces 16,17 are oriented parallel to and spaced four inches apart from one another, and each sidepiece 16,17 presents a respective forward end 16*a*,17*a* and a respective rearward end 16*b*,17*b*. The spacing of the sidepieces 16,17 will depend on the size or diameter of the funnels 12, but should normally be measured in one inch increments so as to correspond to the spacing of the holes 15 in the pegboard 14. Each sidepiece 16,17 is constructed.of steel wire having a diameter of 5.5 millimeters and a length of 16 inches. The diameter or gauge of the steel wire may vary depending on the amount of weight (corresponding, for example, to the number or size of the funnels 12) to be supported. The length of the sidepieces 16,17 may vary in accordance with the depth of the shelf 13 with which the device 10 will be associated, sixteen inches is approximately the average depth of a typical store shelf.

The forward crosspiece 18 extends between and couples the two sidepieces 16,17 by their forward ends 16*a*,17*a*, thereby enhancing the stability of the device 10 and maintaining proper spacing between the sidepieces 16,17. The crosspiece 18 is constructed of steel wire having a diameter of 5.5 millimeters and a length of 4 inches. As illustrated, the crosspiece 18 and the sidepieces 16,17 may be constructed of a single length of steel wire which has been appropriately bent, or may alternatively be constructed of separate pieces which are appropriately coupled (e.g., by welding).

The faceplate 20 provides a surface onto which a price or other label 21 may be affixed for communicating a unit price, bar code, or other information related to the funnels 12. As illustrated, the faceplate 20 is a substantially rectangular 2 inch×1.25 inch flat piece of metal or other material affixed in an appropriate manner (e.g., by welding) to the crosspiece 18.

The two legs 22,23 provide a mechanism by which the device 10 may be secured to the pegboard 14, wherein the pegboard 14 presents the two spaced-apart holes 15 through which the legs 22,23 may be inserted. The legs 22,23 are oriented parallel to and spaced four inches apart from one another, and each leg 22,23 presents a respective lower end 22*a*,23*a* and a respective upper end 22*b*,23*b*. The spacing between the legs 22,23 will depend on the size or diameter of the funnels 12, but should normally be measured in multiples of one inch or, more generally, in whole number multiples of an appropriate unit (e.g., one centimeter) so as to correspond to the spacing of holes in commonly available pegboard material. Each leg 22,23 is constructed of steel wire having a diameter of 5.5 millimeter. The diameter or gauge of the steel wire may vary depending on the amount of weight (corresponding, for example, to the number or size of the funnels) to be supported.

At their lower ends 22*a*,23*a*, each one of the legs 22,23 is coupled with a different one of the sidepieces 16,17 at an angle of approximately 85° or, as desired, at any other suitable angle between approximately 45° and 120°. As illustrated, the legs 22,23 and the sidepieces 16,17 may be constructed of a single length of steel wire which has been appropriately bent, or may alternatively be constructed of separate pieces which are appropriately coupled (e.g., by welding).

At their upper ends 22*b*,23*b*, the legs 22,23 are adapted for engaging the holes 15 of the pegboard 14. As illustrated, each upper end 22,23 presents a substantially S-shaped jog or offset allowing each upper end 22*b*,23*b* to be inserted into one of the holes 15 in the pegboard 14 and to rest behind and against a rear surface of the pegboard 14. The remainder of each leg 22,23, particularly each lower end 22*a*,23*a*, then rests against a front surface of the pegboard 14. In this manner, the legs 22,23 both support the device 10 from and couple it with the pegboard 14, preventing the device 10 from falling or being inadvertently pulled therefrom.

The centerpiece 24 provides a mechanism for engaging the stacked funnels 12 so as to maintain them in the proper orientation relative to the remainder of the device 10. The centerpiece 24 is substantially T-shaped, having a rear bar 24*a* and a center projection 24*b*. The rear bar 24*a* extends between and couples the two legs 22,23. The center projection 24*b* is coupled with an approximate center of the rear bar 24*a* and projects forwardly therefrom and substantially parallel to each of the sidepieces 16,17. The center projection 24*b* is sized and positioned to pass through a spout portion of at least some of the funnels 12 and to thereby support the funnels 12;in cooperation with the sidepieces 16,17.

As illustrated, the centerpiece 24 is constructed of a single piece of steel wire having a length of approximately 20 inches and a diameter of approximately 2.9 millimeters. The rear bar 24*a* is provided by approximately two inches of length at both ends of this wire. The center projection 24*b* is provided by an elongated substantially U-shaped bend in the wire approximately 8 inches long and mo more than 0.4 inches wide, wherein the U-shaped bend is centered along the rear bar 24*a* between the legs 22,23. Each end of the wire is coupled in an appropriate manner (e.g., by welding) with a different one of the legs 22,23 approximately 2.37 inches from the lower end 22*a*,23*a* of each leg 22,23. It will be appreciated that the aforementioned length, positions, and wire diameter will depend on the size and other physical characteristics of the funnels 12. Funnels of other diameters may be accommodated, for example, by spacing the center projection 24*b* from the sidepieces 16,17 a distance equal to the radius of the funnels 12. Thus, for the 6 inch diameter funnels 12 described herein, the center projection 24*b* should be spaced 3 inches from each sidepiece 16,17, which, using simple geometry, means the rear bar 24*a* should couple with the legs 22,23 the aforementioned distance of 2.37 inches from the lower end 22*a*,23*a* of each leg 22,23.

In exemplary use and operation, the device 10 is provided to a retailer as a single unit, with all of the aforementioned couplings and other connections already made, such that the device 10 is ready for immediate use. The upper ends 22*b*,23*b* of the legs 22,23 are placed within the holes 15 in the pegboard 14 and the device 10 is rotated so that the legs 22,23 are oriented substantially vertically, the lower ends of the legs 22,23 rest against the front surface of the pegboard 14, and the sidepieces 16,17 are oriented substantially horizontal and therefore parallel with the shelf 13.

Once mounted, a stack of up to twenty of the funnels 12 may be placed upon the device 10 such that the center projection 24*b* of the centerpiece 24 enters the spouts and exists the bowls of at least a first few rearmost of the funnels 12. Thus, the displayed funnels' spouts will face rearward, toward the pegboard 14, and their bowls will face forward. Alternatively, as desired, the funnels 12 may be placed upon the device 10 such that the center projection 24*b* enters the rearward-facing bowls and exits the forward-facing spouts; a longer center projection 24*b* would facilitate such an arrangement. The retailer may then affix or otherwise secure the price label 21 or code to the faceplate 20.

Thereafter, a customer-may easily remove the forwardmost funnel 12 from the stack, and, if he or she so desires, easily replace the funnel 12 onto the stack without disturbing any other funnels 12 and such that the forwardmost funnel 12 is again properly displayed and ready for removal. Similarly, the retailer may easily remove and replace any number of the funnels 12 without having to thereafter tediously reorient the replaced funnels for proper display.

Thus, it will be appreciated that the device 10 provides a number of significant advantages over the prior art, including, for example, supporting and displaying the funnels 12 in a manner and an orientation which enhances shop-ability by facilitating easier and more convenient consideration, removal, and replacement of one or more of the funnels 12. Furthermore, a funnel 12, once removed, can be easily returned to the stack without disturbing other funnels 12, thereby facilitating maintaining a professional-appearing, properly stacked, and otherwise clean display. Additionally, the device 10 substantially increases optimization of retail shelf space by allowing for the display of a maximum number of funnels 12 in the smallest space possible.

From the preceding description, it will be appreciated that the present invention provides a wire rack device for supporting and displaying a plurality of funnels in a manner and an orientation which facilitates easier and more convenient consideration, removal, and replacement of one or more of the funnels by customers while shopping and by employees while stocking. Although the present invention has been described with reference to the preferred embodiment illustrated in the attached drawings, it is noted that equivalents may be employed and substitutions made herein without departing from the scope of the invention as recited in the claims. Furthermore, applications are contemplated for the present invention that require only minor modifications to the device as disclosed. Thus, for example, variations in physical dimensions and other characteristics, including wire lengths and wire diameters, are contemplated to accommodate funnels of different sizes and designs.

Having thus described the preferred embodiment of the invention, what is claimed as new and desired to be protected by Letters Patent includes the following:

1. A device for supporting a funnel, the device comprising:

a first sidepiece and a second sidepiece, with the first sidepiece being spaced apart from and oriented substantially parallel to the second sidepiece, and each sidepiece presenting a forward end and a rearward end;

a first leg and a second leg, with the first leg projecting at an angle from the rearward end of the first sidepiece and the second leg projecting at an angle from the rearward end of the second sidepiece such that the first leg is spaced apart from and oriented substantially parallel to the second leg, and each leg having an offset portion, wherein the sidepieces and the legs are constructed from a single length of wire; and a centerpiece supported by the legs and having a center projection which projects spaced apart from and substantially parallel to the first sidepiece and the second sidepiece, wherein the funnel can be placed onto the centerpiece such that the centerpiece and the sidepieces cooperate to support the funnel, wherein the offset portion of each leg is placed within a hole in a material so that the remainder of the device is suspended therefrom.

2. A device for supporting a funnel, the device comprising:

a first sidepiece and a second sidepiece, with the first sidepiece being spaced apart from and oriented substantially parallel to the second sidepiece, and each sidepiece presenting a forward end and a rearward end;

a first leg and a second leg, with the first leg projecting at an angle from the rearward end of the first sidepiece and the second leg projecting at an angle from the rearward end of the second sidepiece such that the first leg is spaced apart from and oriented substantially parallel to the second leg, and each leg having an offset portion; and a centerpiece supported by the legs and having a center projection which projects spaced apart from and substantially parallel to the first sidepiece and the second sidepiece, wherein the funnel can be placed onto the centerpiece such that the centerpiece and the sidepieces cooperate to support the funnel, wherein the centerpiece is constructed of a single length of wire which is bent to provide the center projection, wherein the offset portion of each leg is placed within a hole in a material so that the remainder of the device is suspended therefrom.

3. A device for supporting a funnel, the device comprising:

a first sidepiece and a second sidepiece, with the first sidepiece being spaced apart from and oriented substantially parallel to the second sidepiece, and each sidepiece presenting a forward end and a rearward end, with a crosspiece extending between and coupling the forward end of the first sidepiece and the forward end of the second sidepiece;

a first leg and a second leg, with the first leg projecting at an angle from the rearward end of the first sidepiece and the second leg projecting at an angle from the rearward end of the second sidepiece such that the first leg is spaced apart from and oriented substantially parallel to the second leg, and each leg having an offset portion; and a centerpiece supported by the legs and having a center projection which projects spaced apart from and substantially parallel to the first sidepiece and the second side piece, wherein the funnel can be placed onto the centerpiece such that the centerpiece and the sidepieces cooperate to support the funnel, wherein the offset portion of each leg is placed within a hole in a material so that the remainder of the device is suspended therefrom.

4. The device as set forth in claim 3, further comprising a faceplate coupled with the crosspiece and presenting a substantially flat surface whereupon may be affixed a label.

5. A device for supporting a funnel, the device comprising:

a first sidepiece and a second sidepiece, with the first sidepiece being spaced apart from and oriented substantially parallel to the second sidepiece, and each sidepiece presenting a forward end and a rearward end;

a crosspiece extending between and coupling the forward end of the first sidepiece and the forward end of the second sidepiece;

a faceplate coupled with the crosspiece and presenting a substantially flat surface whereupon may be affixed a label;

a first leg and a second leg, with the first leg projecting at an angle from the rearward end of the first sidepiece and the second leg projecting at an angle from the rearward end of the second sidepiece such that the first leg is spaced apart from and oriented substantially parallel to the second leg, and each leg having an offset portion; and a centerpiece supported by the legs and having a center projection which projects spaced apart from and substantially parallel to the first sidepiece and the second sidepiece, wherein the funnel can be placed onto the centerpiece such that the centerpiece and the sidepieces cooperate to support the funnel, wherein the offset portion of each leg is placed within a hole of a material so that the remainder of the device is suspended therefrom.

6. The device as set forth in claim 5, wherein the sidepieces are between approximately 12 inches and 24 inches long.

7. The device as set forth in claim 5, wherein the sidepieces and the legs are constructed from a single length of wire.

8. The device as set forth in claim 5, wherein the legs project from the sidepieces at an angle of between approximately 45° and 120°

9. The device as set forth in claim 5, wherein the distance between the first beg and the second leg is a whole number multiple of 1 inch.

10. The device as set forth in claim 5, wherein the centerpiece is constructed of a single length of wire which is bent to provide the center projection.

11. The device as set forth in claim 5, wherein the center projection is between approximately 6 inches and 12 inches long.

12. The device as set forth in claim 5, wherein the center projection is spaced apart from each of the sidepieces a distance approximately equal to a radius of the funnel.

13. A device for supporting a funnel, the device comprising:

a first sidepiece and a second sidepiece, with the first sidepiece being spaced apart from and oriented parallel to the second sidepiece, and each sidepiece presenting a forward end and a rearward end and being between approximately 12 inches and 24 inches in length;

a first leg and a second leg, with the first leg projecting at an angle of between approximately 45° and 120° from the rearward end of the first sidepiece and the second leg projecting at the same angle from the rearward end of the second sidepiece such that the.first leg is substantially parallel to the second leg and spaced apart therefrom by a distance which is a whole number multiple of 1 inch, and each leg having an offset portion, wherein the sidepieces and the legs are constructed from a single length of wire; and a centerpiece supported by the legs and having a center projection which is between approximately 6 inches and 12 inches long and which projects substantially parallel to the first sidepiece and the second sidepiece and spaced apart therefrom a distance approximately equal to a radius of the funnel, wherein the funnel can be placed onto the centerpiece such that the centerpiece and the sidepieces cooperate to support the funnel, wherein the offset portion of each leg is placed within a hole so that the remainder of the device is suspended therefrom.

14. A device for supporting a funnel, the device comprising:

a first sidepiece and a second sidepiece, with the first sidepiece being spaced apart from and oriented parallel to the second sidepiece, and each sidepiece presenting a forward end and a rearward end and being between approximately 12 inches and 24 inches in length;

a first leg and a second leg, with the first leg projecting at an angle of between approximately 45° and 120° from the rearward end of the first sidepiece and the second leg projecting at the same angle from the rearward end of the second sidepiece such that the first leg is substantially parallel to the second leg and spaced apart therefrom by a distance which is a whole number multiple of 1 inch, and each leg having an offset portion; and a centerpiece supported by the legs and having a center projection which is between approximately 6 inches and 12 inches long and which projects substantially parallel to the first sidepiece and the second sidepiece and spaced apart therefrom a distance approximately equal to a radius of the funnel, wherein the funnel can be placed onto the centerpiece such that the centerpiece and the sidepieces cooperate to support the funnel, wherein the centerpiece is constructed of a single length of wire which is bent to provide the center projection, wherein the offset portion of each leg is placed within a hole so that the remainder of the device is suspended therefrom.

15. A device for supporting a funnel, the device comprising:

a first sidepiece and a second sidepiece, with the first sidepiece being spaced apart from and oriented parallel to the second sidepiece, and each sidepiece presenting a forward end and a rearward end and being between approximately 12 and 24 inches in length, with a crosspiece extending between and coupling the forward end of the first sidepiece and the forward end of the second sidepiece;

a first leg and a second leg, with the first leg projecting at an angle of between approximately 45° and 120° from the rearward end of the first sidepiece and the second leg projecting at the same angle from the rearward end of the second sidepiece such that the first leg is substantially parallel to the second leg and spaced apart therefrom by a distance which is a whole number multiple of 1 inch, and each leg having an offset portion; and a centerpiece supported by the legs and having a center projection which is between approximately 6 inches and 12 long and which projects substantially parallel to the first sidepiece and the second sidepiece and spaced apart therefrom a distance approximately equal to a radius of the funnel, wherein the funnel can be placed onto the centerpiece such that the centerpiece and the sidepieces cooperate to support the funnel, wherein the offset portion of each leg is placed within a hole so that the remainder of the device is suspended therefrom.

16. The device as set forth in claim 15, further comprising a faceplate coupled with the crosspiece and presenting a substantially flat surface whereupon may be affixed a label.

17. A device for supporting a plurality of stacked funnels, the device comprising:

a first sidepiece and a second sidepiece, with the first sidepiece being spaced apart from and oriented substantially parallel to the second sidepiece, and each sidepiece presenting a forward end and a rearward end and being between approximately 12 inches and 24 inches in length;

a crosspiece extending between and coupling the forward end of the first sidepiece and the forward end of the second sidepiece;

a faceplate coupled with the crosspiece and presenting a substantially flat surface whereupon may be affixed a label;

a first leg and a second leg, with the first leg projecting at an angle of between approximately 45° and 120° from the rearward end of the first sidepiece and the second leg projecting at the same angle from the rearward end of the second sidepiece such that the first leg is parallel to the second leg and spaced apart therefrom by a distance which is a whole number multiple of 1 inch, and each leg having an offset portion, wherein the sidepieces, crosspiece, and legs are constructed of a single piece of wire; and a centerpiece supported by the legs and having a center projection which is between approximately 6 inches and 12 inches long and which projects substantially parallel to the first sidepiece and the second piece and spaced apart therefrom a distance approximately equal to a radius of the funnels, the centerpiece being constructed of a single piece of wire which is bent to provide the center projection, wherein the stacked funnels can be placed onto the centerpiece such that the centerpiece and the sidepieces cooperate to support the stacked funnels, wherein the offset portion of each leg is placed within a hole in a material so that the remainder of the device is suspended therefrom.

* * * * *